US005090072A

United States Patent [19]

Gray

[11] Patent Number: 5,090,072

[45] Date of Patent: Feb. 25, 1992

[54] PATIENT LIFTING DEVICE

[75] Inventor: Irwin Gray, Flushing, N.Y.

[73] Assignees: Edward H. Gray; James M. Gray, both of Flushing, N.Y.

[21] Appl. No.: 694,790

[22] Filed: May 2, 1991

[51] Int. Cl.[5] ..... A61G 7/14

[52] U.S. Cl. ..... 5/81.1; 5/86.1

[58] Field of Search ..... 5/81 R, 81 B, 86, 83; 4/560, 561, 562, 564, 565, 566; 414/921

[56] References Cited

U.S. PATENT DOCUMENTS 4,028,752 6/1977 Obertmel ..... 5/86
4,065,179 12/1977 Takasaki ..... 5/86
4,624,019 11/1986 Pennington-Richards ..... 4/566
4,941,216 7/1990 Boublil ..... 5/83

*Primary Examiner*—Alexander Grosz
*Attorney, Agent, or Firm*—Darby & Darby

[57] ABSTRACT

A mechanical aid for lifting handicapped persons, bedridden patients and other individuals of like disposition. The present invention is directed to a lifting device for raising physically incapacitated persons which is operably by a single attendant. To this end, a simple, light weight frame is provided with a slidable, hinged seat which is designed to raise or lower a patient alternatively from lower to higher elevations.

10 Claims, 7 Drawing Sheets

PATIENT LIFTING DEVICE

FIELD OF THE INVENTION

The present invention relates generally to mechanical aids for lifting incapacitated people, and more specifically, to a lifting device for raising physically incapacitated persons, which is operable by a single attendant.

BACKGROUND OF THE INVENTION

This application contains material which was previously submitted under the Disclosure Document Program, which was received in the U.S. patent and Trademark Office on Nov. 6, 1989, and was accorded Disclosure Document No. 239123. The present application is filed within two years of the receipt date, and request is made to transfer that Document to the present application.

Persons with incapacitating disease or injuries and individuals with congenital malformations of the skeletal, muscular or nervous systems cannot raise themselves from a prone position or any other position which requires overcoming the pull of gravity. Also, the natural course of aging weakens the human body, for instance at the hip muscles, making it extremely difficult for the individual to sit up from a prone position or stand from a sitting position, without assistance.

In addition, even if the movement of the patient is on the same level, there are numerous situations in which a lift device is needed. For example, to transfer a patient from a wheelchair to a car seat, the attendant needs a clear, unobstructed space in which to exert bodily leverage for the lift. The actual positioning of the patient on the car seat is extremely difficult because the attendant must bend over to carry the patient's body into the car and all leverage is lost. Such transfers are usually effected with the aid of big, strong attendants for even the smallest patients. In this connection, the device of the present invention makes a transfer of a patient from wheelchair to car seat a matter of moving the patient's body from wheelchair to lift and then from lift to car seat (with easy adjustment, as necessary, between differing levels of chair and car seat). Thus, a particularly strong attendant is not needed.

An additional use of the present invention is for aid in performing a patient's toilet, making it easy to transfer a patient from wheelchair to toilet. By permitting the lift of the patient off the toilet, the present device facilitates a quick and easy cleaning of the body parts involved before transfer back to the wheelchair.

Under most conditions, even without mechanical assistance, lifting debilitated persons from an elevated, sitting position (i.e., from some form of seat) is possible by one person because the lifter can exert leverage against the weight of the person to be lifted. But when the debilitated person is prone or at a lower level (for instance on the floor) the absence of a lifting device requires assistance from two or more people to raise the individual into a wheelchair, onto a bed, or onto a commode. For the average attendant, lifting an incapacitated individual from a level below the height of the attendant's knees or from a prone position is extremely difficult because the individual represents a "dead weight" against the pull of gravity without any type of leverage or fulcrum possible. Additionally, the limbs of such individuals cannot be grasped because of possible injury to already weakened muscles and ligaments, and furthermore, lifting such individuals by the limbs is demeaning when such individuals should be cared for with the gentlest and tenderest of care. The problem is compounded when the person caring for the patient is of advanced age.

Devices operable by a single attendant to lift bedridden patients are known. For instance, a simple miniature crane presently being sold under the designation Hoyer Lift is used in hospitals and rehabilitation centers. However, the end of the crane arm of the Hoyer Lift has to be constructed of a relatively heavy structure to withstand the mechanical torque created by the weight of the patient. This, in turn, leads to the need for an expensive (and heavy) hydraulic ram or a substantial screw mechanism to elevate the heavy crane arm. All this weight has to be countered with an even heavier base to support the crane arm and ram, and to prevent the entire assembly from tipping over. Such lifts can only be used with extreme difficulty in confined spaces, for instance, of small bedrooms, and are practically unusable in the toilet of an average home.

Furthermore, the heavy components and the relatively large size of the Hoyer type patient lifting device makes the device unsuitable for the average homeowner. Moving it from floor to floor requires disassembly on the starting floor, movement of the sub-assemblies, and reassembly for use on a lower or upper level. Where the patient is moved from floor to floor in a home, for example, by means of stair climbing devices, the potential need for a lift device on each floor makes it necessary to buy two or more Hoyer Lifts, something which is generally unfeasible for most families of disabled or handicapped persons. For an institutional user, if an elevator is not available to transfer the lift, it becomes unavailable for any floor on which it has not been stationed. Usually, an emergency requiring its use does not allow the time for its disassembly and reassembly. Institutions must buy multiple units of a device which may get only infrequent use.

OBJECTS OF THE PRESENT INVENTION

It is an object of the present invention to provide a simple, light-weight lifting apparatus for raising incapacitated individuals from a lower elevation to a higher one, and to facilitate lateral transfers such as from wheelchairs to beds, car seats, or toilet seats, and visa versa.

Another object is to manufacture a cost-effective patient lifting device which is simple in design, compact for use in confined areas, and comprised of advanced materials allowing its fabrication with proper strength specifications in the most economical manner.

A further object is to provide a patient lifting device which is light-weight and simple in design for operation by a single attendant, yet of sufficiently durable construction to withstand prolonged and repeated bearing of heavy patient loads. The device is also easily portable so that it can be moved from floor to floor within a dwelling, or stored in the trunk of a car for use at the beginning or end of a trip for transferring a person between the car and a wheelchair.

These and other objects will be apparent to those skilled in the art in light of the following disclosure.

SUMMARY OF THE INVENTION

The present invention includes a lifting device which incorporates a seat member mounted on a unique frame structure. The seat member travels in a tilted vertical direction along the frame, so that a patient is lifted or lowered while seated, face forward in the direction of the incline. Thus, the forward thrust of the patient's weight is utilized advantageously, both for stability and for forward-vertical momentum. The patient is initially placed onto the seat at a lower elevation, then a suitable mechanism is used to raise the seat along the frame.

The lift of the present invention can be made of light weight, durable materials and is easily disassembled into very light subassemblies which can then be carried and re-assembled with ease at a different location, without difficulty, by one person. The lift device requires no cumbersome sling because the patient is secured from the beginning of the lifting procedure by the forward thrust of the patient's weight, in accordance with one aspect of the invention.

Once the patient is elevated, the lift allows shifting of patient's center of gravity, to ease the patient away from lift onto commode, chair, bed or into a car, etc. The procedure is simply reversed to lower the patient from any of these supports.

These and other advantages and improvements will become more apparent from a consideration of the following detailed description.

DETAILED DESCRIPTION OF THE INVENTION

Figure 1:
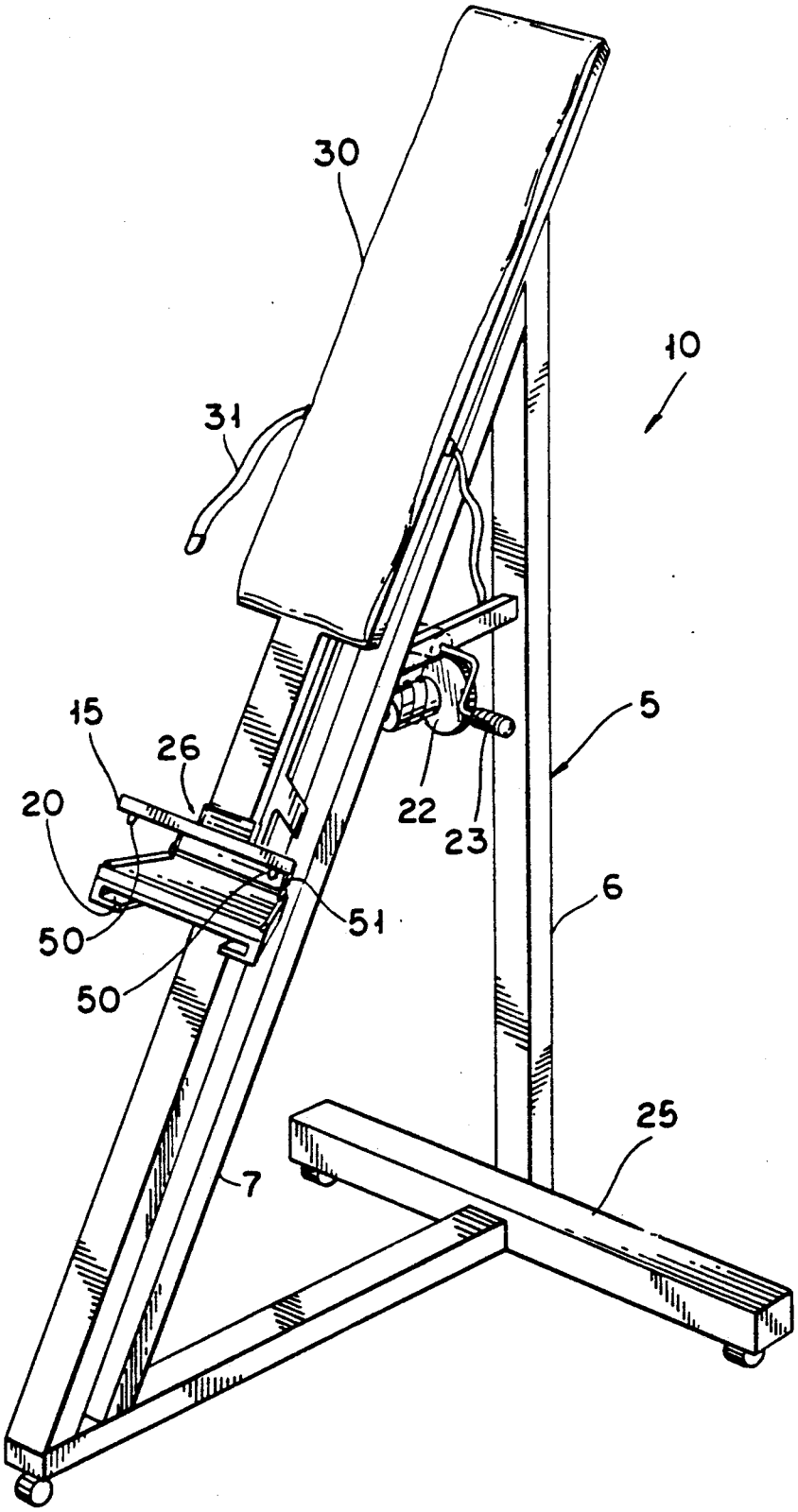
FIG. 1 is a perspective view of one specific illustrative embodiment of the present invention.
Figure 2:
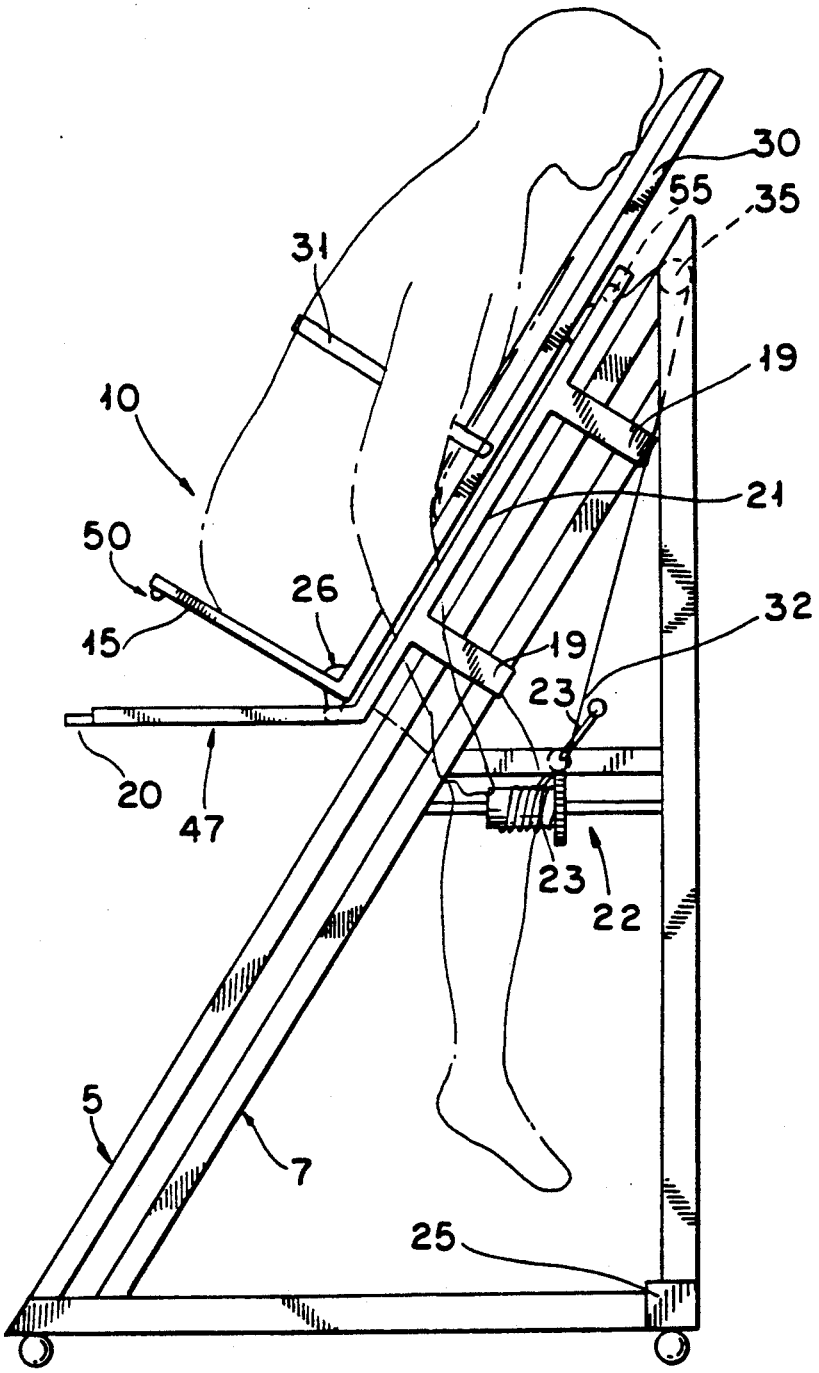
FIG. 2 is a side elevational view of the lift with the seat and front rest shown in the elevated position and pivoted against the sliding support structure.

A lift constructed in accordance with the present invention is designated generally by the reference character 10 in FIG. 1. The basic support for lift 10 is provided by triangular frame 5. FIG. 2 shows frame 5 to be in the form of a right angle triangle including an upright back member 6 and a slanted front member 7. A sliding seat support 21 is clamped to triangle frame 5 by two clamps 19, best seen in FIGS. 2 and 4, such that support 21 slides up and down along the "hypotenuse" or slanted front member 7 of triangle frame 5. Support 21 is attached to a housing support structure 47 which houses telescoping stabilizer channel 20. A patient carrying member having a front rest 30 and a seat 15 is pivotally mounted on housing support structure 47.

Seat 15 is designed to be placed under the buttocks of the person to be lifted and is deliberately kept as small in size as possible so that it can easily be pushed between the legs of a person, or placed into small, confining spaces into which a person might have fallen. For example, this modification could be used in a situation wherein a patient may fall between the sink and the toilet bowl of a bathroom.

Attached to seat 15 is front rest 30, which is the portion of the lift against which the patient's face and chest are placed during the lifting process and can optionally be equipped with suitable padding. The patient is lifted facing and straddling the lift with legs placed on either side of the lifting mechanism, such that the body is tilted towards triangular frame 5 at an angle of approximately 60 degrees (or less), which puts the patient's center of gravity inside the area supported by frame 5. This location of the center of gravity prevents tipping over of lift 10 while the patient is seated thereon. Front rest 30 is equipped with body strap 31 which encircles the patient and prevents falling off the seat 15.

Referring to FIG. 2, front rest 30 is secured to the seat 15 by means of a pivoting hinge 26 which has a maximum travel of 90 degrees. If needed, front rest 30 can be rotated along this hinge axis toward the body of a prone patient so that the strap can be placed around the torso without lifting the patient. As noted in greater detail below, front rest 30 is connected at a point adjacent its top edge to the cable 32. As the cable 32 is tensed, the pivot rest 30 pivots about 26 towards the frame 5 until it reaches a ninety degree angle with respect to seat 15 at which point they pivot as a unit about wheel 51 (FIG. 10) until the front rest 20 rests against the frame 5. At this point, the elements will assume the relative positions shown in FIG. 2. To allow front rest 30 to pivot toward seat 15, the winch 22 must be turned so that cable 32 is given enough slack to permit the movement of front rest 30.

Figure 4:
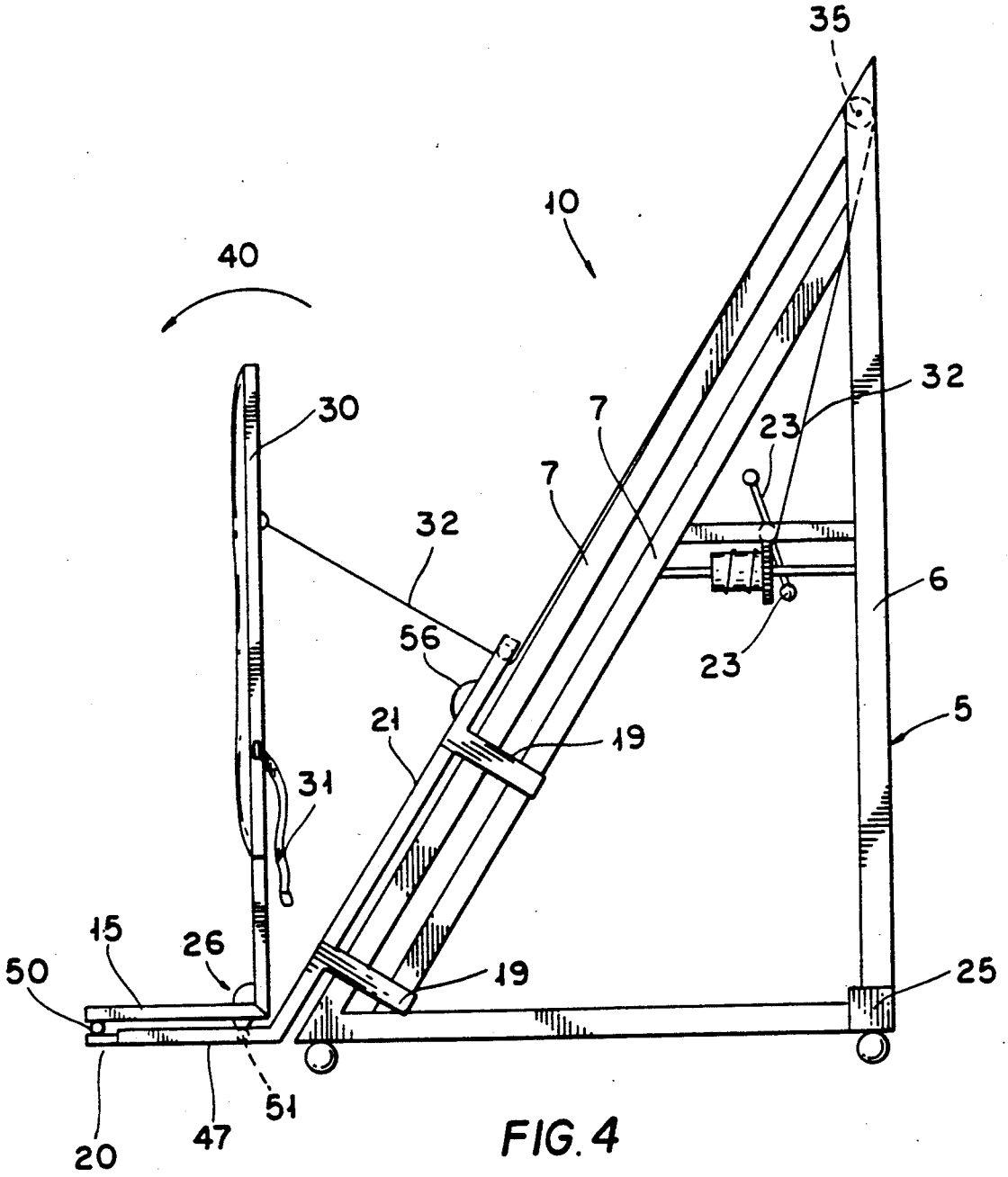
FIG. 4 is a side elevational view showing the seat in a lowered position with the front rest tilted away from the sliding support structure.
Figure 5:
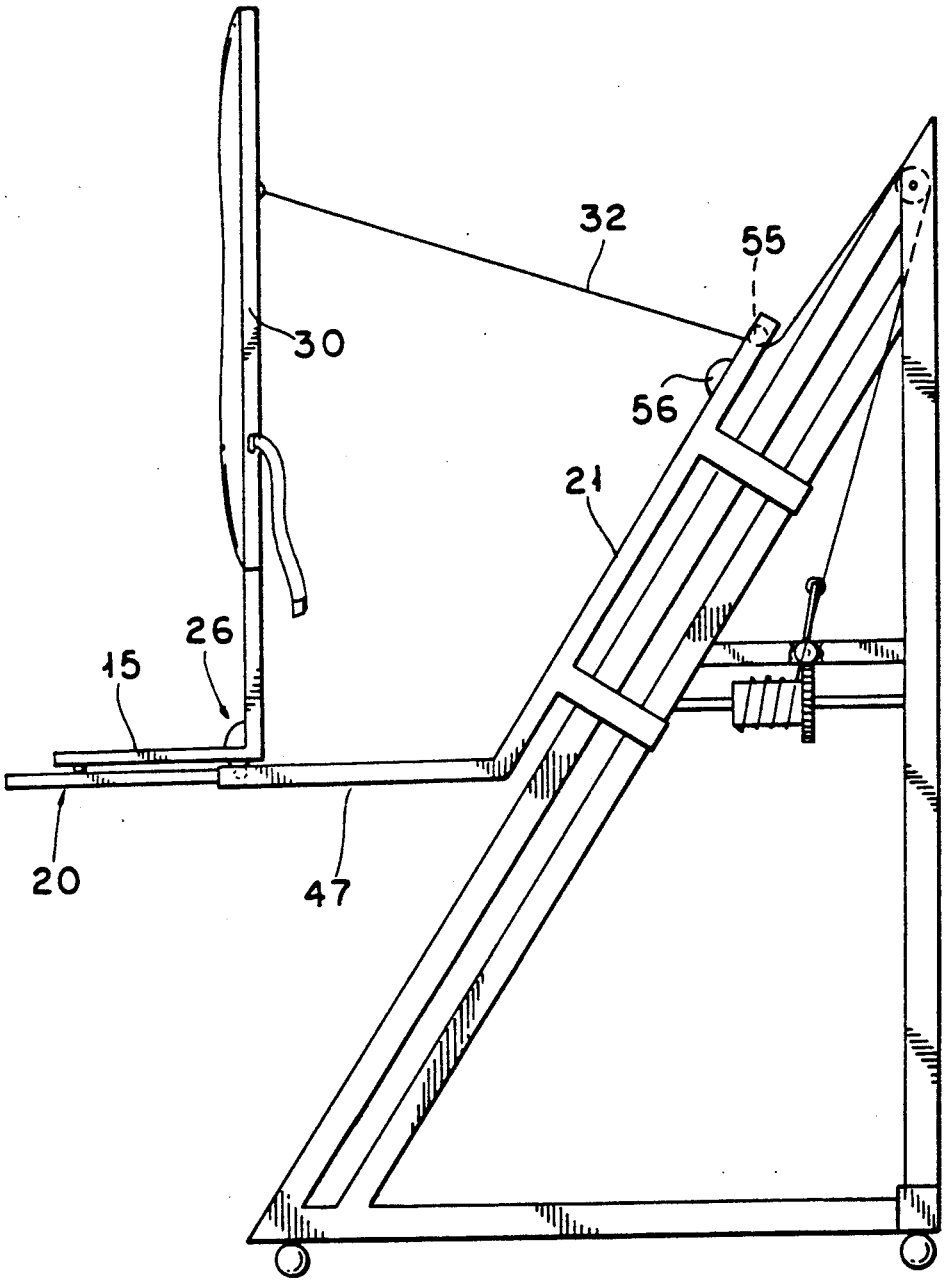
FIG. 5 is a side elevational view showing the seat mechanism in a raised position with the telescoping stabilizer channel extended.

Once the patient is secured by the body strap 31, winch 22 can be activated to wind up cable 32, and front rest 30 is pulled towards triangular frame 5, raising the patient's torso to an upright position on seat 15. At this point, front rest 30 is at 90 degrees with respect to seat 15, and the edges of 15 and 30 engage to prevent further rotation. If seat 15 and front rest 30 have been moved forwardly along extended telescoping stabilizer channel 20 (which has been moved out of housing support structure 47 as shown in FIG. 5], activating winch 22 will pull the seat and front rest back along channel 20 into support structure 47, as shown in FIG. 4. Further activation of winch 22 tightens cable 32 which further pulls on front rest 30, causing the front rest to pivot on back wheels 51 (See also FIG. 10) until it finally comes to rest against bumper 56.

Additional tension on front rest 30 is then transmitted through hinge 26 which causes seat 15 to pivot as well on wheels 51. The movement of front rest 30 and seat 15 together, tips the patient towards triangular frame 5, bringing the patient's center of gravity into the area supported by frame 5. With the patient's weight stabilized, the seat and front rest can be raised off the ground or from a bed or commode on which it was resting without fear of tipping over. Maintaining tension on cable 32 with winch 22 prevents the seat and front rest from moving in any but the desired directions.

Figure 3:
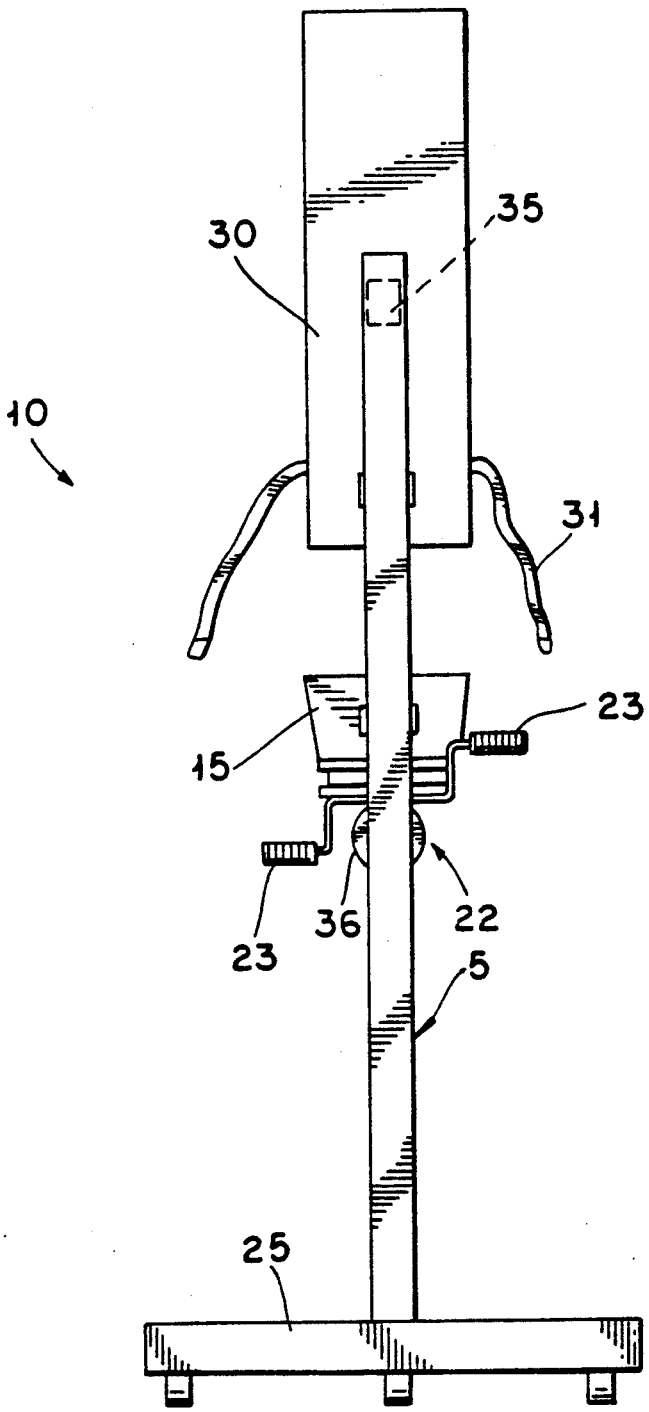
FIG. 3 is a vertical end view of the lift shown in FIG. 2.

Referring to FIG. 3, triangular frame 5 is supported at its vertical, perpendicular axis by a horizontal cross bar 25, giving the connection of frame 5 to bar 25 the shape of an inverted "T." The hypotenuse of triangular frame 5 can optionally have a double bar to give additional support to sliding support 21, which then rides up and down on the two bars. Referring to FIG. 2, frame 5 also supports winch 22 including cable 32 which, in turn, is used to raise or lower sliding support 21 and, therefore, to raise or lower front rest 30 and seat 15. As noted above, cable 32 is attached to front rest 30 via a pulley wheel or slide block 35 supported by frame 5 through a sheave 55 on sliding support 21.

Figure 6:
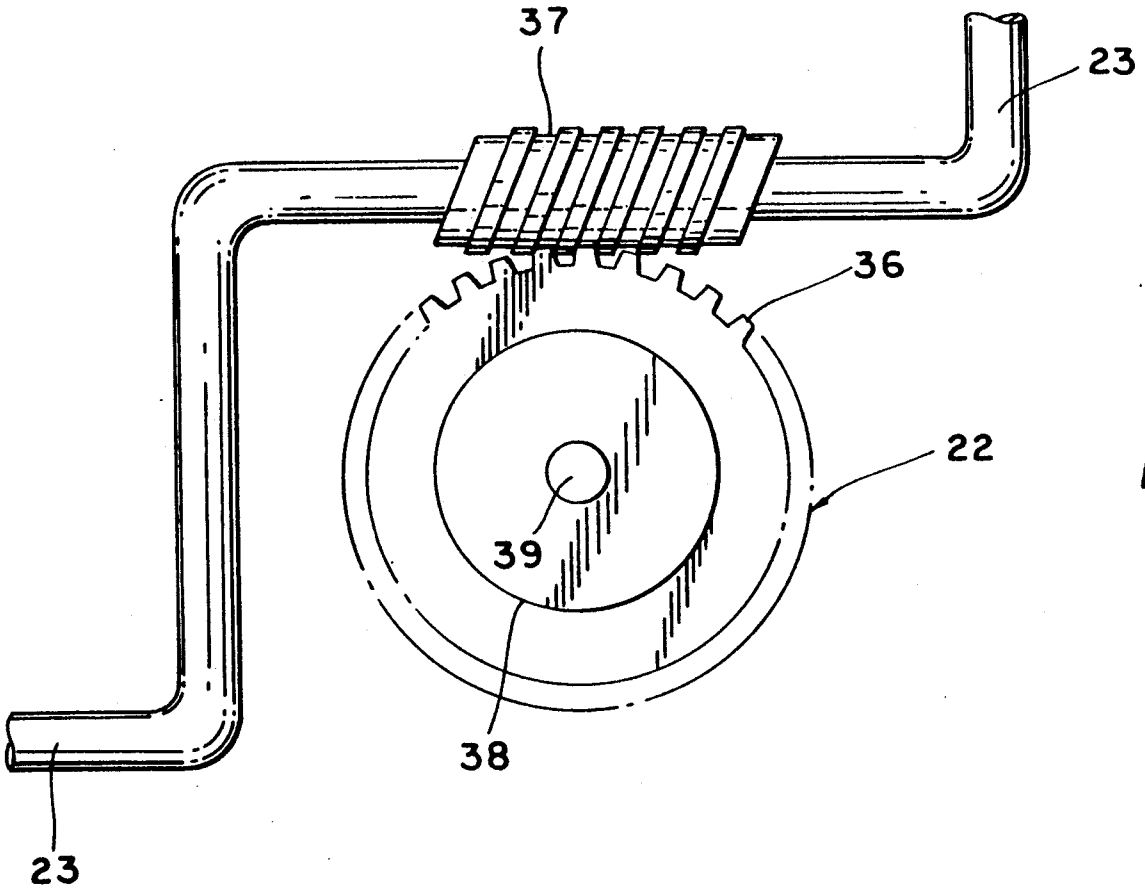
FIG. 6 is a detail view, to enlarged scale, of the worm gear raising mechanism.
Figure 7:
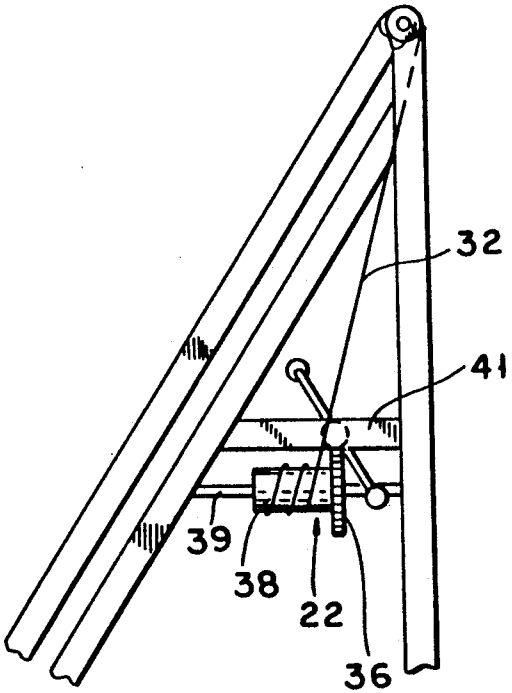
FIG. 7 is a side elevational view of the lift cable mechanism with parts removed to show the operation thereof.

Winch 22 includes a worm gear 36 (FIG. 6) driven by a worm 37 rotated by handles 23. Worm gear 36 and cable drum 38 are both mounted (FIG. 7) on shaft 39. Shaft 39, in turn, is mounted between upright back member 6 and slanted front member 7. Handles 23 are rotatably mounted on support beam 41, also extending between upright back member 6 and slanted front member 7 of frame 5. The worm and worm gear drive mechanism, with appropriate worm to worm gear ratios (such as 1:10), does not rotate backward on its own so that the seat mechanism will not drop by itself. Alternatively, a one way clutch is utilized to prevent inadvertent backward rotation. The clutch functions as a hoist brake if the drum turns without being driven by the hoist turning handles. Rotation of the drum from the handles causes the clutch to override and release the brake. Rotation of the drum in the opposite direction without turning the lift handles locks the clutch which immediately sets the hoist brake to prevent further movement. Clutches which facilitate such drum locking are known in the trade as Sprague Clutches.

FIG. 4 shows seat member 15 in a lowered position and depicts front rest 30 tilted forward and away from sliding support 21 pivoting on wheels 51 in the direction of arrow 40. Stabilizer channel 20 is retracted in its housing support structure 47. Seat 15 and channel 20 are both horizontally oriented. The configuration (FIG. 5) is used at necessary heights to place or take off the patient. Channel 20 is extended so seat 15 can be pushed forward while channel 20 rests on a bed or commode to prevent tipping of lift.

Figure 10:
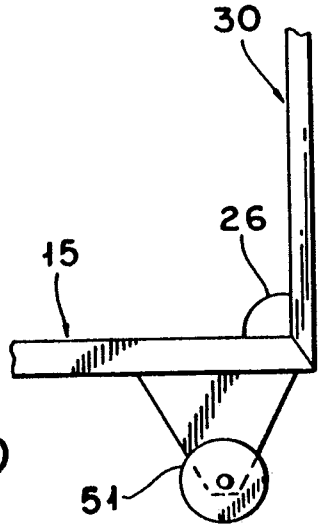
FIG. 10 is a detail view, to enlarged scale, of the rear seat pivot wheel position of the present invention.

The cable 32 (FIG. 5) extends through a sheave 55 at the end of the support bar 21 and is connected to the end of the front rest 30. A pulley wheel or teflon sliding block can also be used instead of sheave 55. The housing support structure 47 connected to sliding support 21 is advantageously a broad H section, with a widened bar joining the vertical parts at the center and with inwardly facing caps on top and bottom of the H piece. Housing support structure 47 is solidly secured as by welding to the support 21 to make one single, strong piece. Housing support structure 47 is also hollow so that the U-shaped channel 20 can be either recessed within housing 47 or extended therefrom to provide support for the seat 15. Channel 20 has grooves on its top surface for front wheels 50, wheels 50 being affixed to the bottom of seat 15 adjacent to end thereof (FIG. 10).

Figure 8:
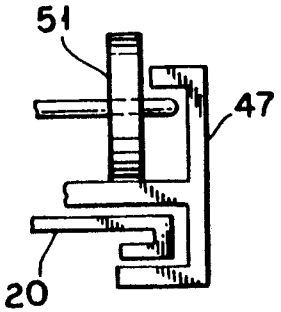
FIG. 8 a detail view of the telescoping stabilizer channel and the housing support structure arrangement in relation to a back wheel of the seat of the present invention.
Figure 9:
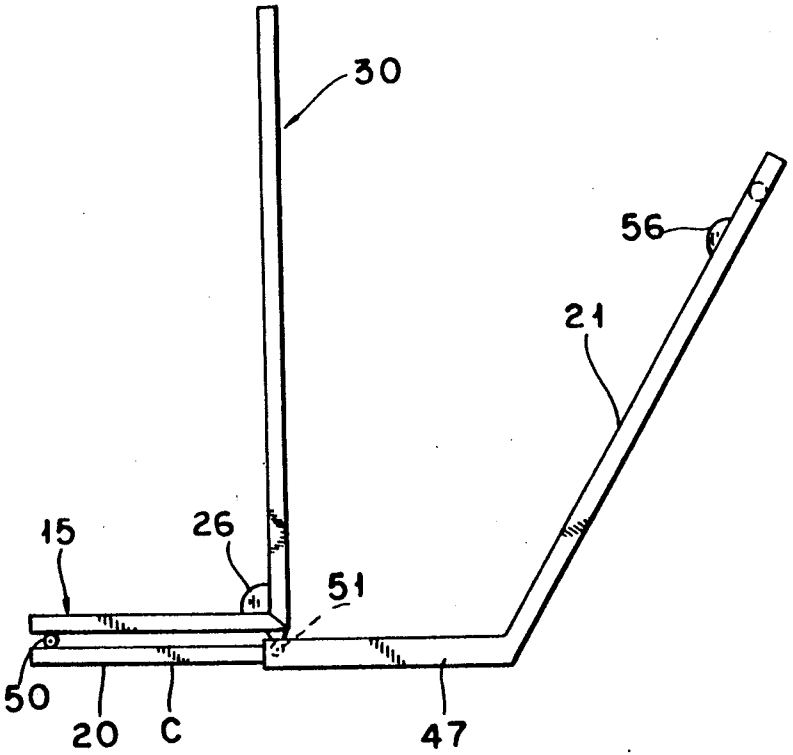
FIG. 9 is a side elevational view of the seat member and front rest shown extended from the housing support structure along the stabilizer channel.

As shown in FIG. 9, the front rest 30 is hinged at pivot 26, and seat 15 runs on two sets of wheels 50 (front) and 51 (back). As stated above, front wheels 50 run in grooves located on channel 20. Back wheels 51, however, run inside the top channel of housing support structure 47 (FIG. 8). When seat 15 is retracted, the seat and front rest 30 both pivot on wheels 51 so that the front rest pivots backwards against support 21. With the seat in the tilted position, channel 20 can be slid back into its housing 47. A portion of channel 20 extends beyond the end of housing 47 to provide a resting position for front wheels 50 whenever seat 15 is set parallel to the ground.

In operation, lift 10 is pushed forward between the legs of the patient and the patient's buttocks are lifted onto seat 15. Next, the patient's upper torso is lifted and gently urged forward against front rest 30. Strap 31 is then fastened around the torso. Winch 22 is used to reel back rest 30 against support 21, and continues to lift and elevate the entire support with the strapped-in patient. Winch 22, as described above, has a step-wise locking or clutch system to prevent uncontrolled movement of cable 32 in either direction.

Handles 23 can be used to manually lift sliding seat support 20, but an electric motor can easily be adapted to turn screws (also optionally adaptable) raising seat 15 to proper heights above a bed or wheelchair. If an electric motor is installed, the manual handles become backups in case of power failure.

Following elevation of the patient, a wheelchair, for example, is placed under seat 15 or lift 10 is moved toward a bed, so that seat 15 hangs over the peripheral device selected. If, however, obstructions prevent the lift frame from being pushed under the bed or commode so that the seat 15 does not hang over the peripheral device, telescoping channels 20 is extended over the peripheral device from within housing support structure 47. The channels 20 are extended forward to rest on a chair, bed or toilet for support creating a "bridge" in such a way that the whole lift mechanism does not tip over. The seat 15 and channels 20 are lowered so that the bar now rests firmly on the peripheral device. The patient seat 15 is now pushed forwards until it is at least partially over the peripheral device, then the patient's body, once released from the straps, is gently eased backwards off the seat or the latter is pulled out from under the buttocks. The seat is then moved rearwardly, the channels 20 are retracted, and the lift is pulled away.

The following table lists actual specifications used in making an embodiment of the present invention:

TABLE 1

(Based on patient weight of 250 lbs. maximum)

| Set Parameters with a 60 Degree Angle | | | |
|---|---|---|---|
| 1 | Height of rise from ground | 24.0 | inches |
| 2 | Shield height above set | 35.0 | inches |
| 3 | Width of seat holding person | 6.0 | inches |
| 4 | Front to back length of seat | 10.0 | inches |
| 5 | Patient weight (max.) | 210 | lbs. |
| 6 | Design weight (50% allowance) | 375 | lbs. |
| 7 | Design weight along plane | 325 | lbs. |
| 8 | Shield supported at seat bottom and above seat by | 18.0 | inches |
| 9 | Angle of hypotenuse (lift arm) | 60.0 | degrees |
| 10 | Angle of hypotenuse (lift arm) | 1.0 | radian |
| 11 | Seat travel along hypotenuse | 27.7 | inches |
| 12 | Total and allowances on hypotenuse | 2.0 | inches |
| 13 | Length of hypotenuse including shield clamp | 47.7 | inches |
| 14 | Length of floor bar | 23.9 | inches |
| 15 | Length of rear vertical | 41.3 | inches |
| 16 | Let circumference of rope drum be | 15.7 | inches |
| 17 | Radius of rope drum | 2.5 | inches |
| 18 | Handle length established | 6.5 | inches |
| 19 | User force at end of handle set | 9.0 | lbs. |
| 20 | Load's pull on cable | 325.0 | lbs. |
| 21 | Turns of handle to lift | 26.0 | rev. |
| 22 | Patients Mech. Adv.: Load/Force | 27 | |
| 23 | Load/Driver Gear Ration R2/R1 | 15 | |
| 24 | Safety-friction gear allowance | 10% | |
| 25 | Seat at max. height | 24.0 | inches |

TABLE 1-continued

| (Based on patient weight of 250 lbs. maximum) | |
|---|---|
| Set Parameters with a 60 Degree Angle | |
| 26 Front of seat to edge | 14.0 inches |
| 27 Rear of seat to edge | 4.0 inches |
| 28 Length of telescoping seat-slide channel | 15.0 inches |

Several options are possible for seat 15. For instance, it can be supplemented with a web type arrangement or an opening for use over a toilet. Other options which are obvious to those skilled in the art are encompassed within the spirit of this invention.

What is claimed is:

1. A lifting device for elevating a person from a lower position to a higher position comprising a frame having an upright back member and a slanted front member, a support member slidably connected to said front member, a carrying member pivotally connected to said support member and including a seat on which the person to be raised may be positioned, and a rest portion extending upwardly from said seat, and a drive means connected to said frame for moving said carrying member against said support member and for raising said support member along said front member.

2. A lifting device in accordance with claim 1, further comprising at least a channel slidably reclined in said support member and extendable to support said carrying member thereon.

3. A lifting device in accordance with claim 1 wherein said drive means include a cable extending through the top of said support member and connected to the top of said carrying member.

4. A lifting device in accordance with claim 3 wherein said drive means further includes a cable drum supported by said frame member and means for rotating said cable drum.

5. A lifting device in accordance with claim 4 wherein said rotating means includes a gear connected to said cable drum, a worm meshing with said gear, and means for rotating said worm.

6. A lifting device in accordance with claim 1 further comprising cushioning material on said rest portion of said carrying member against which the upper body portion of the person to be lifted will abut when the person is straddling said seat, and a strap to be placed around the upper body portion of the person to be lifted.

7. A patient lift device comprising a triangular frame having an upright back member and a slanted front member, a support member slidably attached to said front member, a carrying member having a seat and a front rest, and pivot means on said carrying member for pivotally mounting said carrying member on said support member said carrying member being laterally slidable relative to the support member, and winch means for causing said support member and said carrying member attached thereto to slide on said front member between at least a lower and an upper position, said winch means including a cable for raising said support member.

8. A lift device in accordance with claim 7 wherein said winch means includes pulley means at the top of said frame for guiding said cable and pulley means at the top of said support member, said cable being connected to said carrying member.

9. A lift device in accordance with claim 8 further comprising a telescoping channel connected to said support member and movable between a retracted and an extended position to support said carrying member.

10. A lift device in accordance with claim 9 wherein said front member is slanted at an angle of about 60 degrees.

* * * * *